US007310899B1

(12) United States Patent
Costa et al.

(10) Patent No.: US 7,310,899 B1
(45) Date of Patent: Dec. 25, 2007

(54) IRONING BOARD

(76) Inventors: Charles A. Costa, 12658 N. 98th Pl., Scottsdale, AZ (US) 85260; Kristine Costa, 12658 N. 98th Pl., Scottsdale, AZ (US) 85260

( * ) Notice: Subject to any disclaimer, the term of this patent is extended or adjusted under 35 U.S.C. 154(b) by 0 days.

(21) Appl. No.: 11/526,477

(22) Filed: Sep. 25, 2006

(51) Int. Cl.
*D06F 81/06* (2006.01)
*A47B 3/00* (2006.01)
*D06F 81/00* (2006.01)

(52) U.S. Cl. ..... 38/137; 108/42

(58) Field of Classification Search ..... 38/103, 38/104, 135, 139; 108/37, 39, 42, 47, 48, 108/134; 312/245
See application file for complete search history.

(56) References Cited

U.S. PATENT DOCUMENTS 1,213,475 A * 1/1917 Gardner ..... 108/33
1,699,766 A * 1/1929 Starr et al. ..... 108/48
1,833,997 A * 12/1931 Keebler ..... 108/39
4,155,609 A * 5/1979 Skafte et al. ..... 312/245
4,862,811 A * 9/1989 Davis ..... 108/134
4,961,388 A * 10/1990 Simpson ..... 108/42
6,253,472 B1 7/2001 Gast ..... 38/137
6,491,173 B1 12/2002 Costa ..... 211/126.15
6,679,392 B1 1/2004 Costa ..... 211/94.01
7,062,871 B1 6/2006 Smidt ..... 38/104
7,100,316 B2 9/2006 Obileye ..... 38/139

* cited by examiner

*Primary Examiner*—Ismael Izaguirre
(74) *Attorney, Agent, or Firm*—Vidas, Arrett, Steinkraus

(57) ABSTRACT

The present invention provides an ironing board assembly which includes an ironing board and a sliding rail assembly for attachment with a partition in a closet system. The sliding rail assembly includes at least one fixed member slidingly and pivotally engaged to at least one sliding arm. At least a portion of an ironing board is pivotally engaged to a sliding arm.

19 Claims, 7 Drawing Sheets

IRONING BOARD

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

The present invention is directed toward an ironing board and, in particular, to a stowable ironing board that may be installed on a partition via a sliding, pivoting rail assembly.

2. Description of the Related Art

Closet or cabinet installed ironing boards are well known apparatuses. They efficiently utilize space within residential homes, and commercial spaces such as hotel rooms. These residential homes and commercial spaces maximize the space available in a room by providing additional shelving, drawers, and closet space within a closet system.

Further space-saving within a room is achieved by providing a space within the closet system for storage of an ironing board. An ironing board generally has two positions—an upright, stowed position, into which the ironing board is collapsed for storage in the closet system space, and an unstowed position, into which the ironing board is extended for ironing garments.

Although further room space-saving is realized by stowing an ironing board within the closet system itself, this necessarily reduces the amount of space available within the closet system. For example, in U.S. Pat. No. 7,062,871, the entire contents of which being incorporated herein by reference, while the closet system is designed to stow an ironing board, the ironing board is stored with the ironing surface parallel to the front of the closet system. Storing the ironing board in this position requires that the shelving be reduced in size in order to accommodate the dimensions of the ironing board, thus reducing the shelf storage space.

Other closet mounted ironing boards, although stored upright with the ironing surface perpendicular to the front of the closet system (i.e. with the ironing surface parallel with and adjacent to a partition), restrict the placement of the ironing board in its unstowed position. For example, in U.S. Pat. No. 6,253,472, the entire contents of which being incorporated herein by reference, the ironing board in its unstowed position must be placed such that the ironing surface is perpendicular to the front of the closet system, because the arm is fixed to a vertical surface of the closet system. This restriction is undesirable for several reasons. For instance, there may not be sufficient space available in the room to extend the ironing board perpendicular to the front of the closet system. Also, it is oftentimes desirable to adjust the placement of an ironing board if the lighting available in the room is poor or if the room lighting is blocked by someone using the ironing board.

Thus, a need exists for an ironing board assembly that is attached to a partition by a sliding rail assembly and which pivots once the ironing board assembly is removed from the interior of the closet system.

BRIEF SUMMARY OF THE INVENTION

One embodiment of the present invention addresses this need by providing a slidingly stowable ironing board assembly having an ironing board and a sliding rail assembly. The sliding rail assembly has at least fixed member and at least sliding arm. A sliding arm is designed to slidingly engage the fixed member. A sliding arm is also designed to slide or roll along a fixed member in a longitudinal direction. And, a sliding arm is pivotally engaged to a fixed member, such that the sliding arm and the fixed member have a non-pivoted state and a pivoted state. In the non-pivoted state, the sliding arm is positioned substantially parallel to the fixed member, and in the pivoted state the sliding arm defines an angle with the fixed member. This pivoting allows the ironing board to move such that the ironing board surface need not be perpendicular to the front of the closet system when the ironing board is in its unfolded, garment-ironing position.

In some embodiments, the slidingly stowable ironing board assembly pivots such that the angle between the fixed member and the sliding arm is between 1 and 90 degrees. In other embodiments, the slidingly stowable ironing board assembly can be designed to pivot such that the angle between the fixed arm and the sliding arm is greater than 90 degrees.

In some embodiments the ironing board assembly includes a partition. In a preferred embodiment, the fixed member engages the partition of a closet system, cabinet, or organizing system.

In a preferred embodiment, the slidingly stowable ironing board assembly also includes a leg assembly. In a preferred embodiment, the leg assembly is pivotally engaged to the ironing board. In one embodiment, the leg assembly has a single leg. In some embodiments, the leg assembly has two or more legs. In some embodiments with leg assemblies with multiple legs, there is at least one stabilizing member extending between the legs.

One embodiment has a leg assembly that has an adjustable length. In some embodiments, the leg assembly includes at least one foot. In an embodiment, the at least one foot of the leg assembly is extendible.

In other embodiments, the sliding arm further comprises a bracket, at least a portion of the ironing board being pivotally engaged to the bracket. In other embodiments, the ironing board assembly further comprises a support assembly. The support assembly has a first arm, a second arm, and a plate. The first arm and second arm each have a first end and a second end. The plate includes a channel, and the plate is fixedly engaged to the ironing board. The first end of the first arm is pivotally engaged to the leg assembly at a first pivot joint and the second end of the first arm is pivotally engaged to the first end of the second arm at a second pivot joint. The second pivot joint is slidingly disposed within the channel. The second end of the second arm pivotally engaged to the bracket.

In another embodiment, the ironing board assembly also includes an extendable/retractable shaft, which has a first end and a second end. The first end of the extendable/retractable shaft is pivotally engaged to the second arm of the support assembly, and the second end of the extendable/retractable shaft is pivotally engaged to the plate.

BRIEF DESCRIPTION OF THE DRAWINGS

A detailed description of the invention is hereafter described with specific reference being made to the drawings.

DETAILED DESCRIPTION OF THE INVENTION

Figure 1:
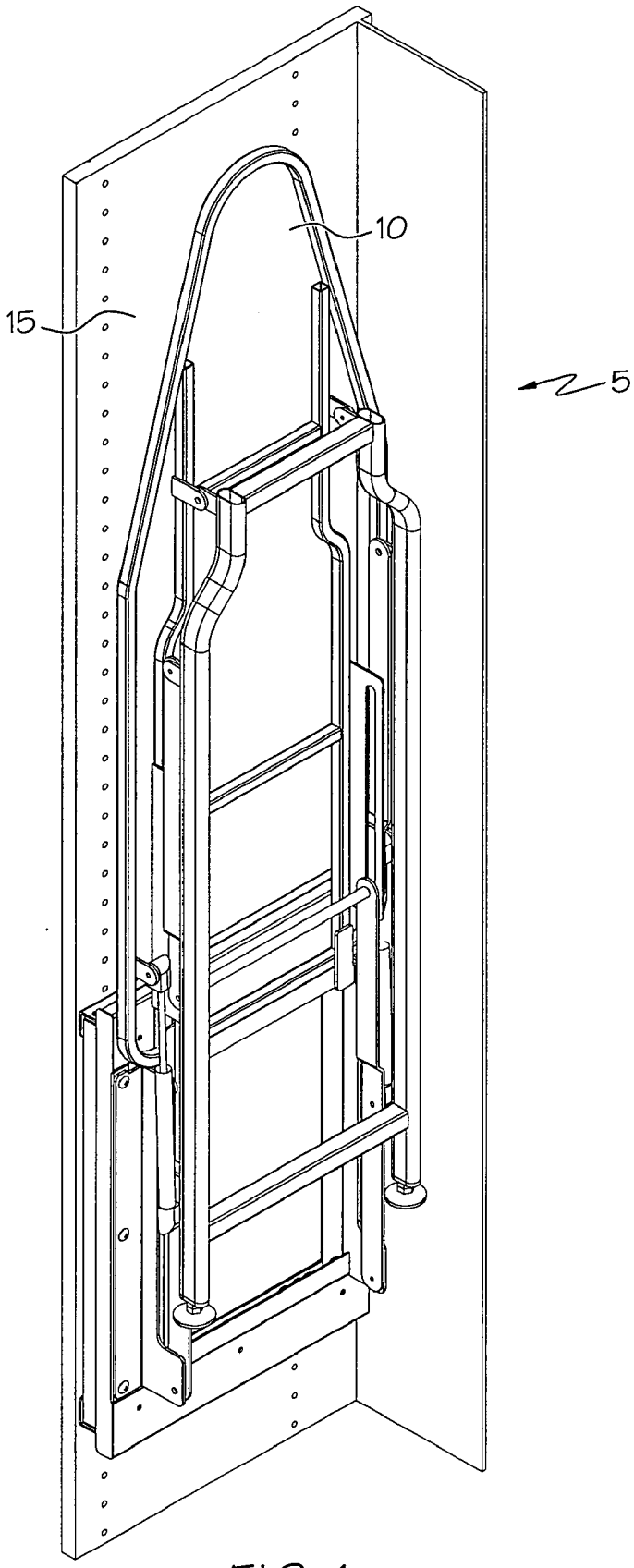
FIG. 1 is a perspective view of a left-mounted embodiment of the invention, comprising an ironing board assembly, shown in an upright, folded, stowed position.

A first embodiment of the invention is shown in FIG. 1. An ironing board assembly 5 is shown in an upright, folded, stowed, left-mounted position within a closet.

In the various embodiments shown, the assembly 5 is comprised of a variety of components that provide an ironing board 10 with a variety of mounting and use positions, and the capacity to be readily moved between them.

The ironing board 10 of the ironing board assembly 5 depicted in FIG. 1 is adjacent to and parallel with a partition 15. Although the partition 15 depicted in FIGS. 1-7 are vertical pieces of a closet, it should be noted that the ironing board assembly can engage any vertical surface.

Figure 2:
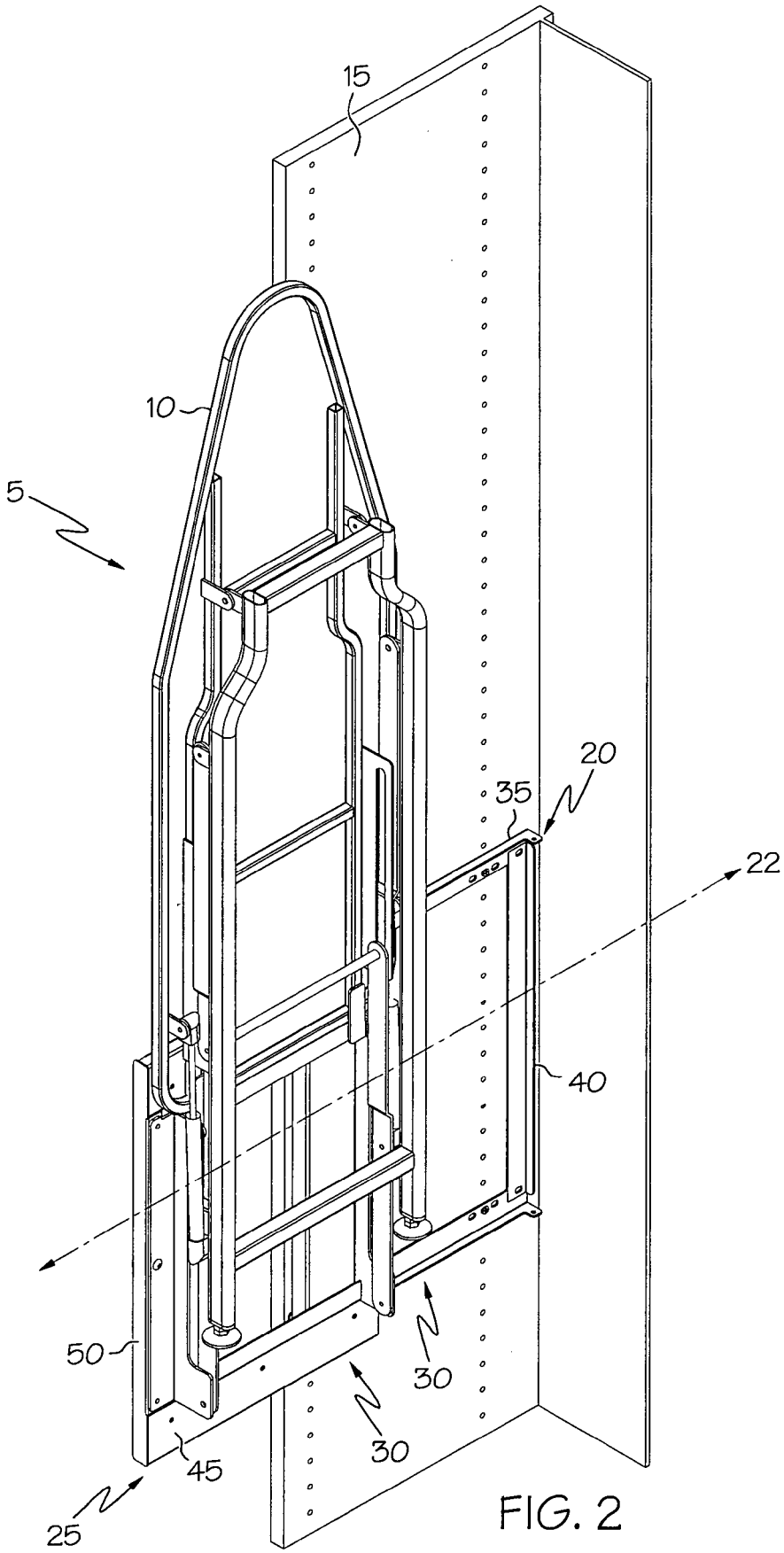
FIG. 2 is a perspective view of the ironing board assembly of FIG. 1, shown in an upright, folded, partially stowed position.

For example, in the embodiment shown in FIG. 2, the assembly 5 comprises a fixed assembly 20 and includes a fixed member rail 35, which is designed to be readily engaged to the partition 15. The assembly 5 also includes a sliding assembly 25, which has one or more sliding arms 45 that slidingly or otherwise moveably engage the fixed member 35, in order to provide the ironing board 10 with slideable movement along the partition 15.

As shown in FIG. 2, the ironing board assembly 5 has been slid partially out of the closet, parallel to partition 15 along fixed member 35 and longitudinal axis 22. The sliding is accomplished by the sliding engagement of fixed member 35 with sliding arm 45.

The specific manner in which the fixed member 35 and sliding arm 45 are engaged with one another can be any sort of movable engagement, such as in the manner of a slide rail assembly, roller assembly, etc. In at least one embodiment, at least a portion of the fixed member 35 and sliding arm 45 are engaged in the manner of a slide mechanisms described in U.S. Pat. No. 6,679,392 and/or U.S. Pat. No. 6,491,173, the entire content of each being incorporated herein by reference.

Figure 3:
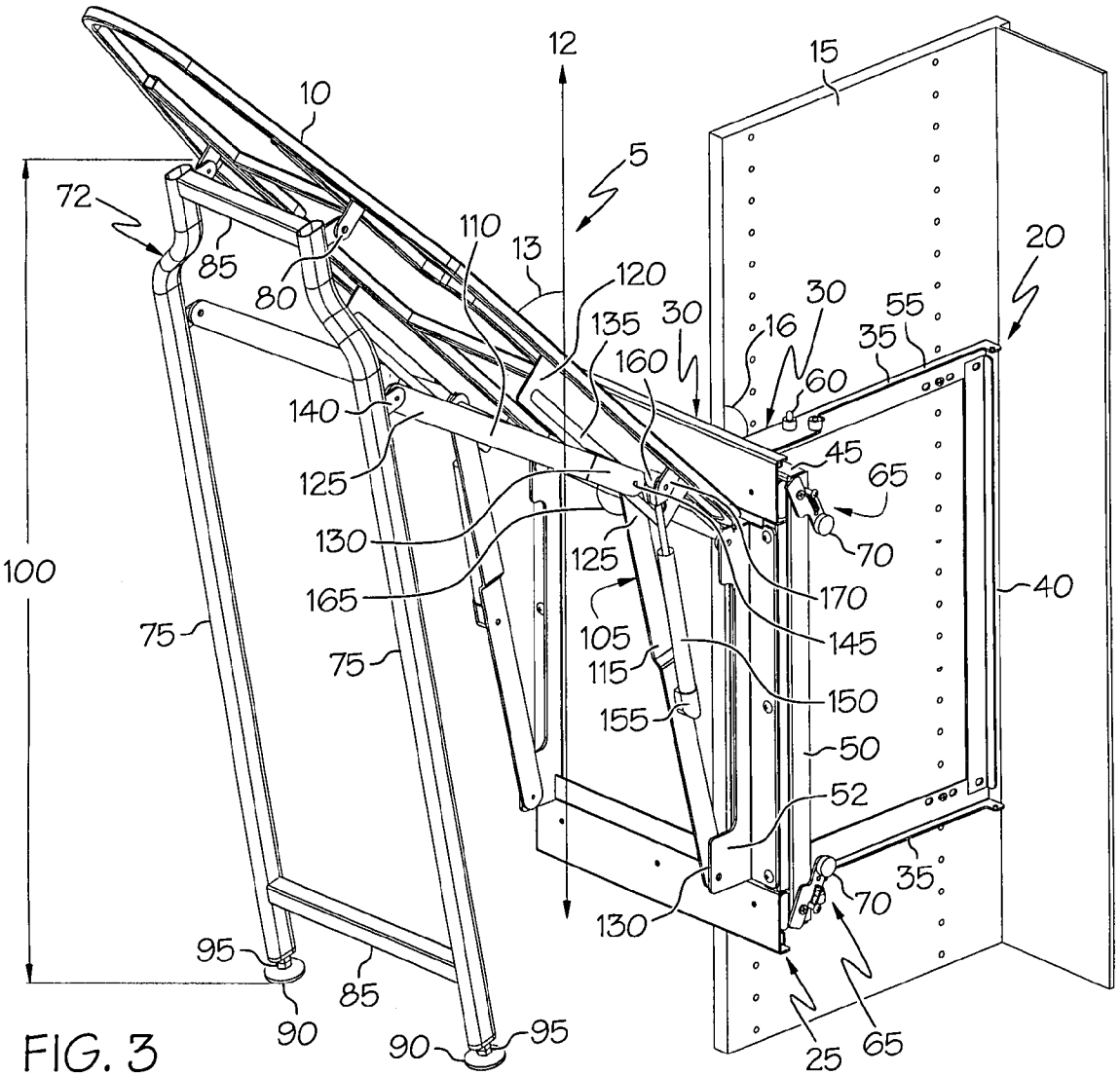
FIG. 3 is a perspective view of the ironing board assembly of FIG. 1, shown in a partially unfolded, completely unstowed, pivoted position.

FIG. 3 depicts the ironing board assembly 5 of FIG. 2, now completely slid out of the closet and pivoted an angle 16 away from the surface of the partition 15. The fixed member 35 and the sliding arm 45 are also pivotally engaged to one another to provide a non-pivoted state and a pivoted state. In the pivoted state, such as shown in FIG. 3, the sliding arm 45 defines angle 16 with fixed member 35. Angle 16 will generally be between 1 and 90 degrees, with FIG. 3 depicting an angle of approximately 90 degrees. Of course, it is envisioned that angle 16 could be less than or greater than 90 degrees as well. In some embodiments for example it is desired to allow the ironing board to be pivotally rotated to the side of a partition opposite to which it is mounted. As such, the sliding arm 45 will pivot more than 180 degrees, but less than 360 degrees around the end of the fixed member 35 to achieve the desired position.

FIG. 2 depicts fixed member 35 and sliding arm 45 in a non-pivoted state.

The fixed assembly 20 may comprises at least one fixed member 35 and may also include a bracket 40. The fixed member 35 is engaged to the partition 15 and the bracket 40 is engaged to both the fixed member 35 and the partition 15.

The sliding assembly 25 may comprise at least one sliding arm 45 and may also include a bracket 50. The sliding arm 45 is designed to receive/contain the length of the fixed member 35 when the slide rail assembly 30 is in a retracted state, as in FIG. 1. As the slide rail assembly 30 transitions from a retracted state, such as the position shown in FIG. 1, to an intermediate state in which the slide rail assembly 30 is partially extended, such as is shown in FIG. 2, the sliding arm 45 receives/contains a decreasing portion of the length of the fixed member 35.

In at least one embodiment, the sliding arm 45 includes a track which is designed to receive the rail 55 of fixed member 35. The sliding arm 45 receives the rail 55 of the fixed member 35 via a track roller 60 fixedly engaged to the fixed member 35. The track, with track walls, has a width slightly greater than the diameter of the track roller 60. The track roller 60 slidingly or rollingly engages the track walls of the sliding arm 45, thereby guiding the sliding arm 45 together with the fixed member 35. The sliding arm 45 mail contain, wheels, rollers, bearing balls (not depicted) within a bearing ball retainer (not depicted), etc. to provide sliding or rolling engagement between the sliding arm 45 and fixed member 35.

An important feature of the invention, as mentioned above, is the ability of the ironing board assembly 5 to pivot at an angle 16 away from the surface of partition 15. The interaction between the sliding arm 45 and the fixed member 35 via the track and track roller 60 is described above. By changing the dimensions of the track, or by any other method well known in the slide rail art, the sliding arm 45 can be designed to release the engagement between the track and the track roller 60, and consequently, the engagement between the sliding arm 45 and the fixed member 35. For instance, the sliding arm 45 can be designed to include a shortened track-one that does not extend along the entire length of the sliding arm 45. Once the track roller 60 reaches the end of the track, the track roller 60 exits the track and the engagement between the fixed member 35 and the sliding arm 45 via the track ceases. By releasing the engagement between the track and the track roller 60, the movement of the sliding arm 45 is no longer restricted to a single plane parallel to the surface of partition 15. Obviously, without some other engagement point, the sliding arm 45 would simply fall. Therefore, the slide rail assembly 30 includes a pivot point at which sliding arm 45 is pivotally engaged to a fixed member 35. This pivotal engagement allows the sliding arm 45 to pivot away from the surface of partition 15, thereby increasing the angle 16 as it pivots outwardly.

In addition to the track roller 60, the sliding assembly 25 may further include a guide roller assembly 65. Guide roller assembly 65 is pivotally engaged to the sliding assembly 25 and acts to align the sliding arm 45 with the fixed member 35 when the ironing board assembly 5 is being returned to its folded, stowed position within the closet. As the sliding arm 45 is pivoted, thereby decreasing angle 16 to 0 degrees (i.e. sliding arm 45 is parallel to the surface of the partition 15), guide roller assembly 65, specifically guide roller 70, slidingly or rollingly engages the fixed member 35. As the guide roller 70 is advanced along the fixed member 35, the track of sliding arm 45 is aligned with the track roller 60. Further advancement of the guide roller 70 along the fixed member 35 results in engagement between the track and the track roller 60.

FIG. 3 also shows the ironing board assembly comprising a leg assembly 72. Leg assembly 72 has at least one leg 75. Some embodiments, like the one depicted in FIG. 3, have two legs 75. The leg assembly 72 is pivotally engaged to ironing board 10 at a pivot joint 80. For a leg assembly 72 comprising multiple legs 75, at least one stabilizing member 85 is desirable. Stabilizing member 85 extends between legs 75, thereby providing stabilization by substantially preventing unwanted transverse motion.

Additionally, the leg assembly 72 may further include a foot 90. Foot 90 may include shaft 95. Leg 75 can be designed to accept some or all of the length of shaft 95, thereby allowing the leg assembly length 100 to be adjustable. Although not depicted, it is envisioned that that the legs 75 of the leg assembly 72 can be telescopic, allowing for additional and/or alternative length adjustment.

Still referring to FIG. 3, ironing board assembly 5 may further include at least one support assembly 105. The support assembly 105 preferably includes a first arm 110, a second arm 115, and a plate 120. The first arm 110 and the second arm 115 each have first ends 125 and second ends 130. Plate 120 is fixedly engaged to the ironing board 10, and defines a channel 135. The first end 125 of the first arm 110 is pivotally engaged to the leg assembly 72 at a pivot joint 140. The second end 130 of the first arm 110 is pivotally engaged to the first end 125 of the second arm 115 at a pivot joint 145. Pivot joint 145 is slidingly disposed within the channel 135 and the second end 130 of the second arm 115 is pivotally engaged to bracket 52.

The support assembly 105 may further include an extendable/retractable shaft 150 having a first end 155 and a second end 160. The first end 155 of the extendable/retractable shaft 150 is pivotally or rotatably engaged to the second arm of the support assembly 105 and the second end 160 of the extendable/retractable shaft 150 is pivotally or rotatably engaged to plate 120. The extendable/retractable shaft 150 is biased toward expansion in length. Extendable/retractable shaft 150 may be spring-loaded, or preferably, may be pressurized with gas (such as a gas spring).

Figure 4:
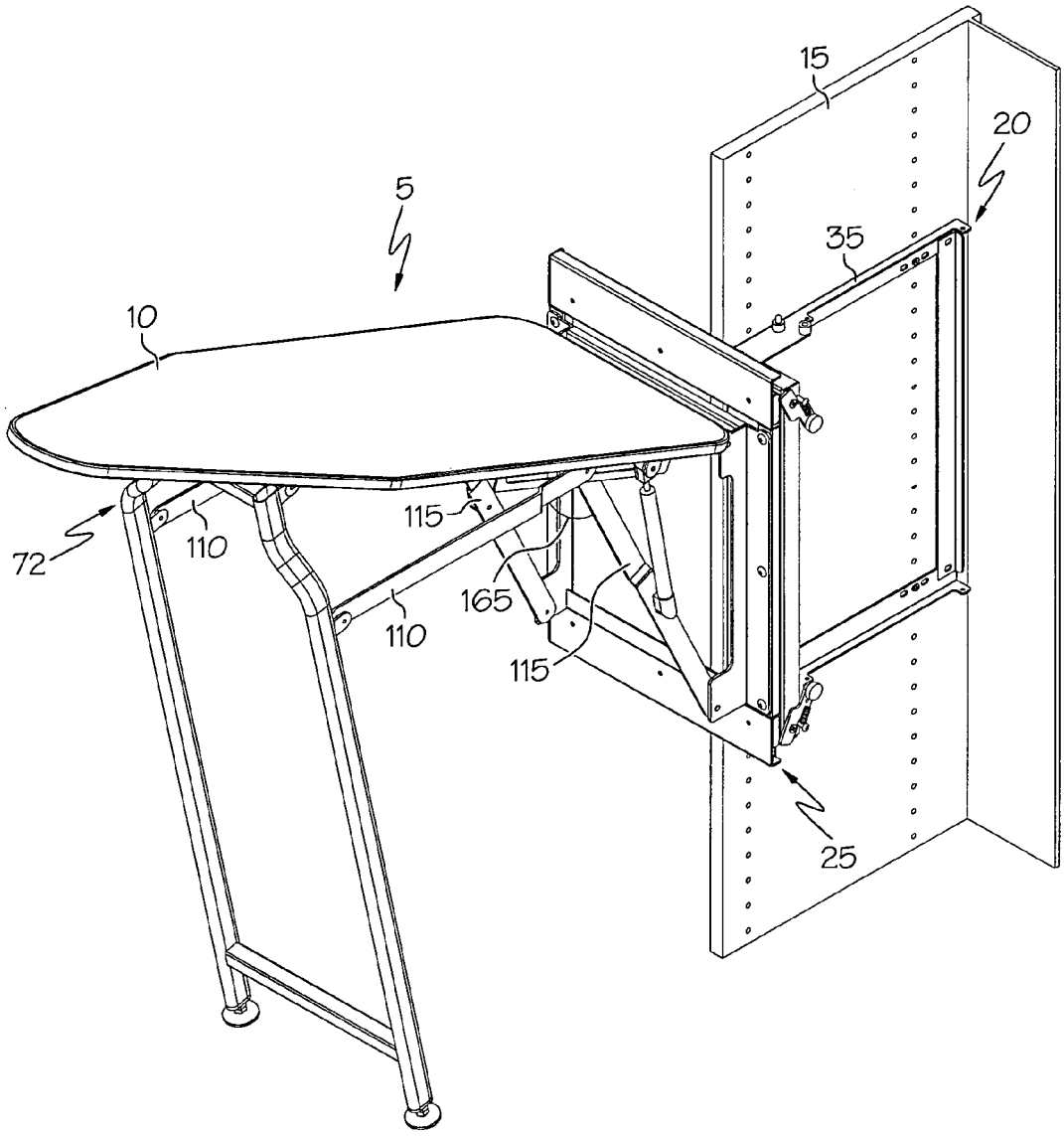
FIG. 4 is a perspective view of the ironing board assembly of FIG. 3, shown further unfolded.

FIG. 4 shows the ironing board assembly 5 of FIG. 3 in an intermediate unfolded position. Although the ironing board 10 is not completely horizontal, the angle 165 formed between the first arm 110 and second arm 120 of the support assembly has been further reduced from the angle 165 shown in FIG. 3.

Figure 5:
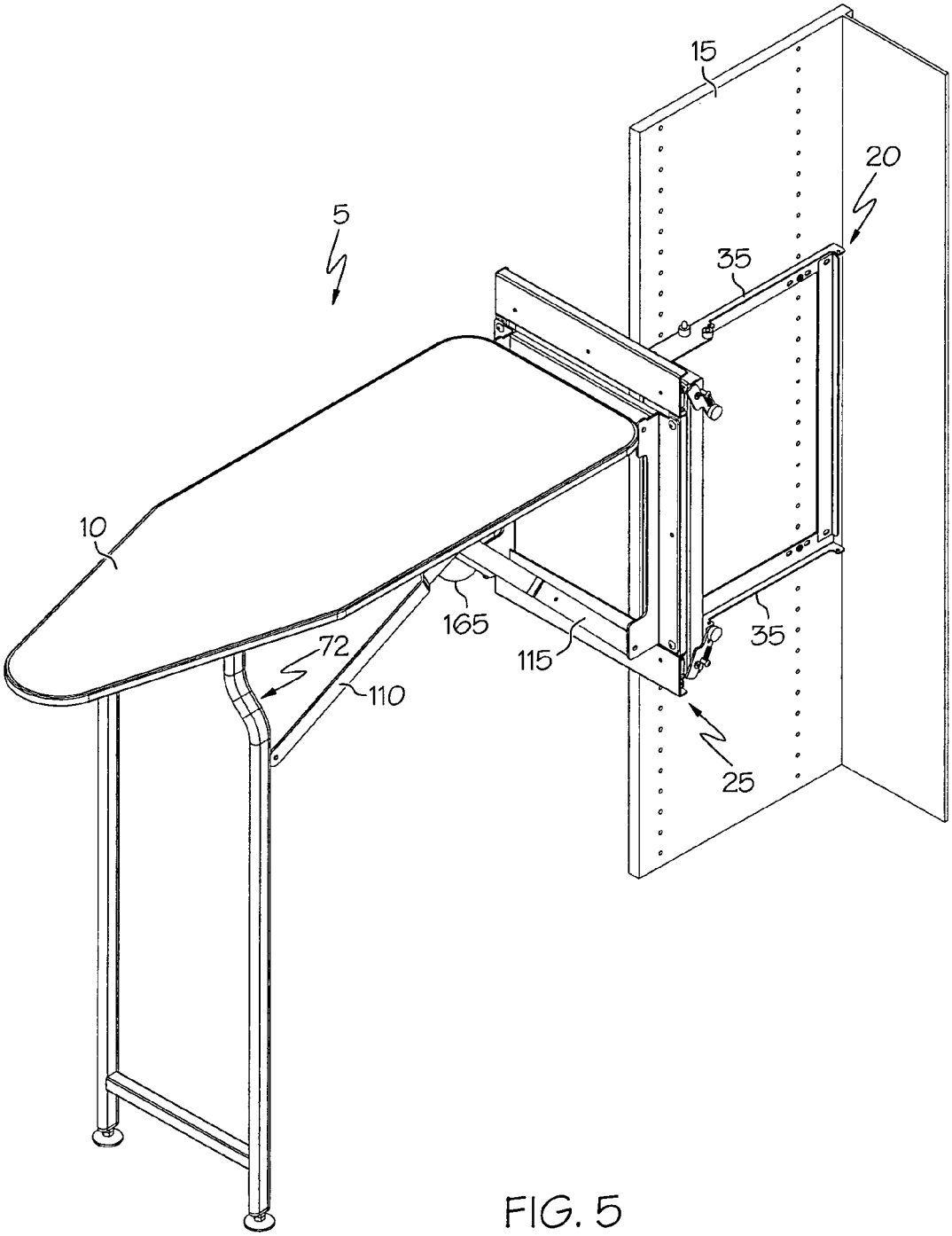
FIG. 5 is a perspective view of the ironing board assembly of FIG. 4, shown completely unfolded.

Referring now to FIG. 5, the ironing board assembly 5 of FIG. 4 has been further unfolded into a completely unfolded position. Ironing board 10 is substantially horizontal, with angle 165 further reduced from the angle 165 shown in FIG. 4.

Figure 6:
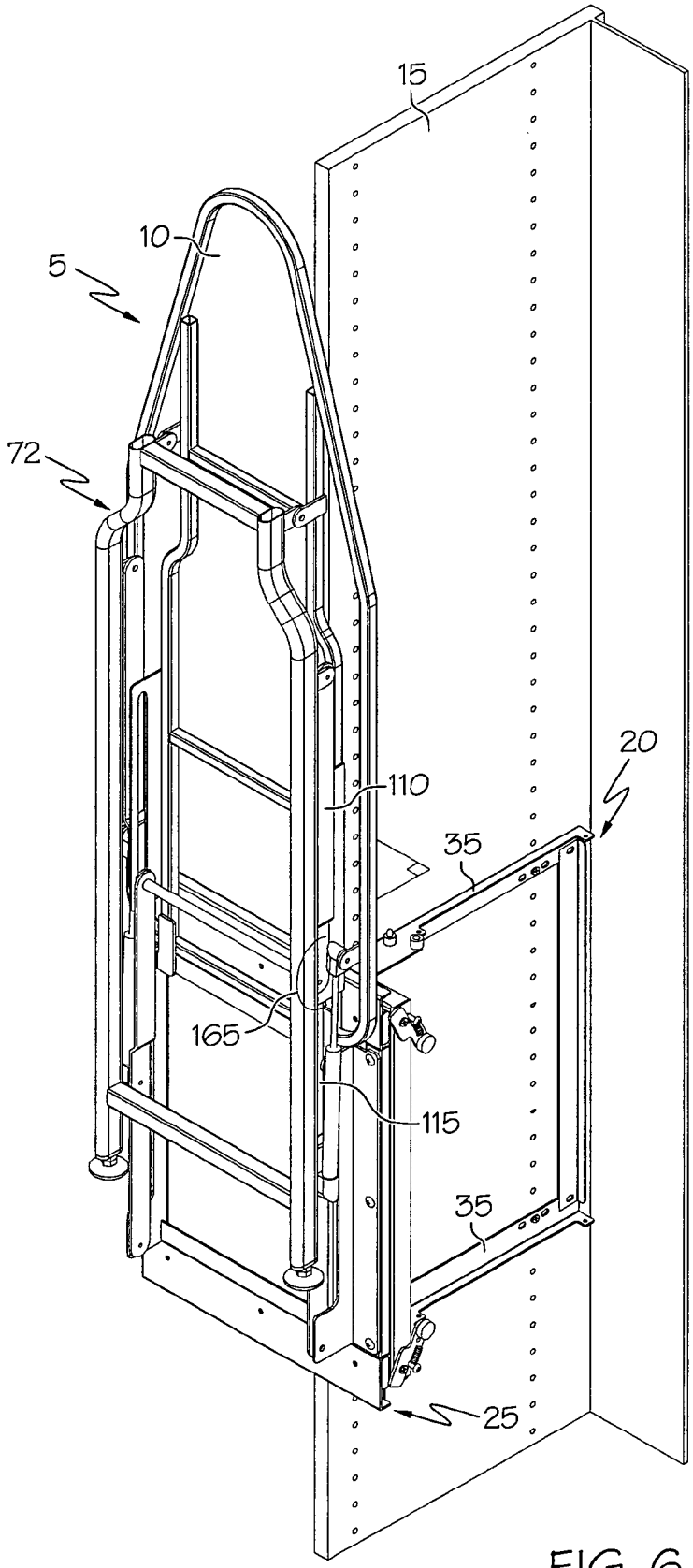
FIG. 6 is a perspective view of the ironing board assembly of FIG. 1, shown in an upright, folded, completely unstowed, pivoted position.

Referring now to FIG. 6, the ironing board assembly 5 of FIG. 5 has been folded into a completely folded but unstowed position. The angle 165 between first arm 110 and second arm 120 of the support assembly is now approximately 180 degrees. The leg assembly 72 is now folded up with the ironing board 10. Ironing board 10 remains perpendicular to the partition 15. Stowing the ironing board assembly 5 simply requires pivoting sliding arm 45, and then advancing the sliding arm 45 along the fixed member 35, as depicted in FIG. 2.

Figure 7:
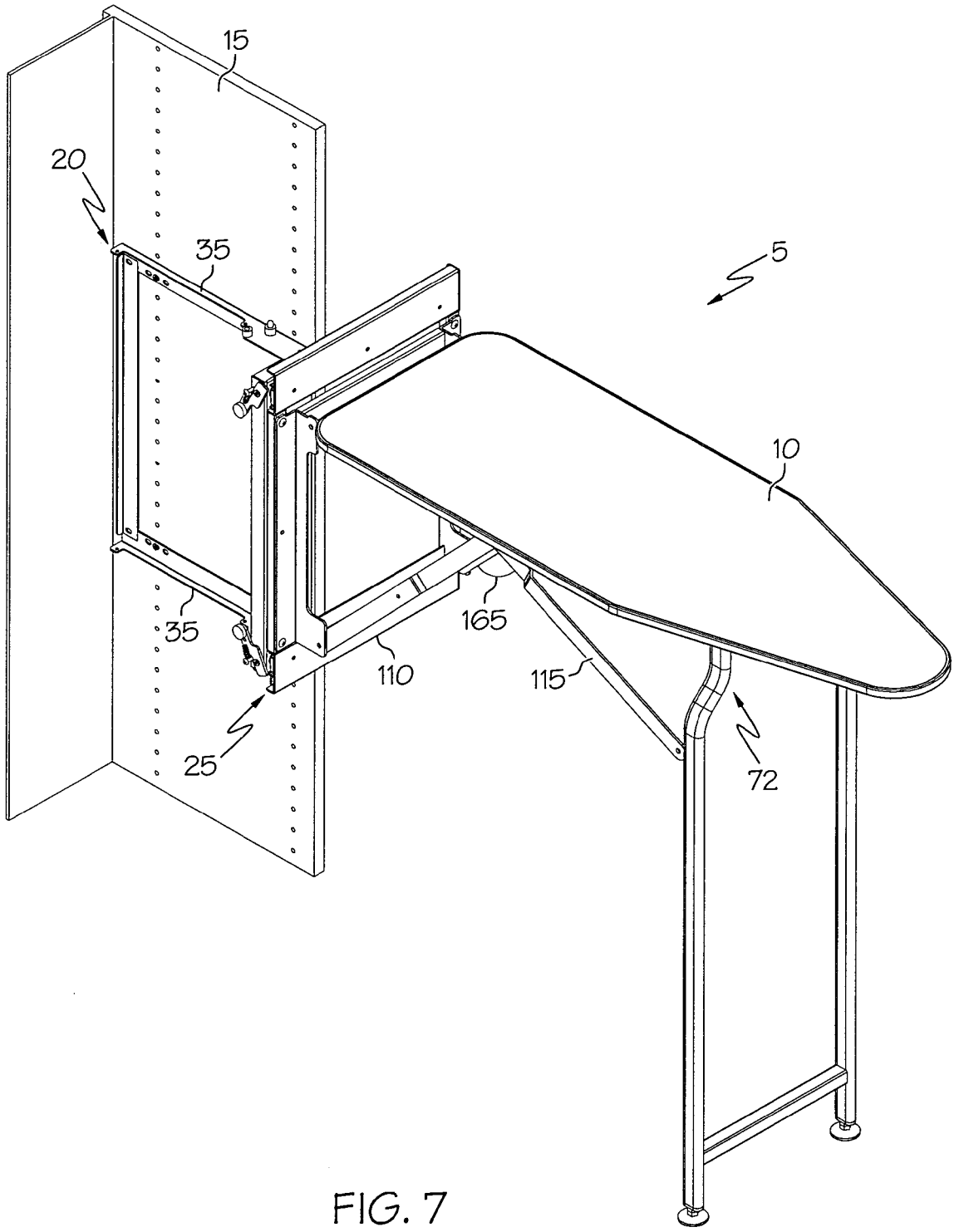
FIG. 7 is a perspective view of the ironing board assembly of FIG. 1, shown right-mounted and completely unfolded.

FIGS. 1 through 6 depict a left-mounted ironing board assembly. However, it should be obvious that it is straight forward to switch the placement of the rail member arm assembly and make the ironing board assembly right-mounted. FIG. 7 depicts a completely unfolded, right-mounted ironing board assembly 5.

The above disclosure is intended to be illustrative and not exhaustive. This description will suggest many variations and alternatives to one of ordinary skill in this art. The various elements shown in the individual figures and described above may be combined or modified for combination as desired. All these alternatives and variations are intended to be included within the scope of the claims where the term "comprising" means "including, but not limited to".

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A slidingly stowable ironing board assembly comprising:

a sliding rail assembly, the sliding rail assembly comprising at least one fixed member and at least one sliding arm, the at least one sliding arm slidingly engaged to the at least one fixed member, the at least one sliding arm further being pivotally engaged to the at least one fixed member, the at least one sliding arm and the at least one fixed member having a non-pivoted state and a pivoted state, wherein in the non-pivoted state the sliding arm is positioned substantially parallel to the fixed member, and in the pivoted state the sliding arm defines an angle with the fixed member;

an ironing board, at least a portion of the ironing board being pivotally engaged to the sliding arm, the ironing board having a substantially vertical position, a substantially horizontal position, and intermediate positions therebetween; and at least one support assembly, wherein the at least one support assembly supports the ironing board in the substantially vertical position, the substantially horizontal position, and intermediate positions therebetween, the at least one support assembly comprising a plate fixedly engaged to the ironing board;

an extendable/retractable shaft having ends, at least one end of the extendable/retractable shaft being engaged to the plate.

2. The slidingly stowable ironing board assembly according to claim 1, wherein the angle is between 1 and 90 degrees.

3. The assembly according to claim 1, wherein the angle is at least 90 degrees.

4. The assembly according to claim 1, wherein the at least one fixed member is engaged to a partition.

5. The assembly according to claim 1, further comprising a leg assembly, the leg assembly pivotally engaged to the ironing board.

6. The assembly according to claim 5, the leg assembly comprising at least one leg.

7. The assembly according to claim 5, the leg assembly comprising at least two legs.

8. The assembly according to claim 7, the leg assembly comprising at least one stabilizing member, the at least one stabilizing member extending between the at least two legs.

9. The assembly according to claim 5, wherein the leg assembly has a length, the length being adjustable.

10. The assembly according to claim 5, wherein the leg assembly further comprises at least one foot.

11. The assembly according to claim 5, wherein the sliding arm further comprises a bracket, the at least a portion of the ironing board being pivotally engaged to the bracket;

the at least one support assembly further comprising a first arm and a second arm, each of the first arm and second arm having a first end and a second end, the plate defining a channel, the first end of the first arm pivotally engaged to the leg assembly at a first pivot joint, the second end of the first arm pivotally engaged to the first end of the second arm at a second pivot joint, the second pivot joint slidingly disposed within the channel, the second end of the second arm pivotally engaged to the bracket.

12. A method of making an ironing board assembly comprising the steps of:

providing a sliding rail assembly, the sliding rail assembly comprising at least one fixed member and at least one sliding arm, the at least one sliding arm slidingly engaged to the at least one fixed member, the at least one sliding arm further being pivotally engaged to the at least one fixed member, the at least one sliding arm and the at least one fixed member having a non-pivoted state and a pivoted state, wherein in the non-pivoted state the sliding arm is positioned substantially parallel to the fixed member, and in the pivoted state the sliding arm defines an angle with the fixed member;

providing an ironing board, at least a portion of the ironing board being pivotally engaged to the sliding arm;

providing at least one support assembly, the at least one support assembly comprising a plate fixedly engaged to the ironing board;

providing an extendable/retractable shaft having ends, at least one end of the extendable/retractable shaft being engaged to the plate; and attaching the at least one first assembly to a partition.

13. The method according to claim 12, wherein the sliding arm further comprises a bracket, the at least a portion of the ironing board being pivotally engaged to the bracket, and wherein the at least one support assembly comprises a first arm and a second arm, each of the first arm and second arm having a first end and a second end, the plate including a channel, the first end of the first arm pivotally engaged to the leg assembly at a first pivot joint, the second end of the first arm pivotally engaged to the first end of the second arm at a second pivot joint, the second pivot joint slidingly disposed within the channel, the second end of the second arm pivotally engaged to the bracket.

14. The method according to claim 13, wherein the extendable/retractable shaft has a first end and a second end, the first end of the extendable/retractable shaft being pivotally engaged to the second arm of the support assembly, the second end of the extendable/retractable shaft pivotally engaged to the plate.

15. The method according to claim 14, further comprising the step of providing a leg assembly, the leg assembly pivotally engaged to the ironing board.

16. The method according to claim 15, wherein the step of providing a leg assembly includes providing at least one leg.

17. The method according to claim 15, wherein the step of providing a leg assembly includes providing at least two legs.

18. The method according to claim 17, wherein the step of providing a leg assembly includes providing at least one stabilizing member, the at least one stabilizing member extending between the at least two legs.

19. A slidingly stowable ironing board assembly for use in a closet organizing system comprising:

a sliding rail assembly, the sliding rail assembly comprising at least one fixed member and at least one sliding arm, the at least one sliding arm slidingly engaged to the at least one fixed member, the sliding arm comprising a bracket, the at least one sliding arm further being pivotally engaged to the at least one fixed member, the at least one sliding arm and the at least one fixed member having a non-pivoted state and a pivoted state, wherein in the non-pivoted state the sliding arm is positioned substantially parallel to the fixed member, and in the pivoted state the sliding arm defines an angle with the fixed member;

a partition, the at least one fixed member engaged to the partition;

an ironing board, at least a portion of the ironing board being pivotally engaged to the bracket;

a leg assembly, the leg assembly pivotally engaged to the ironing board;

at least one support assembly, the at least one support assembly comprising a first arm, a second arm, and a plate, each of the first arm and second arm having a first end and a second end, the plate defining a channel, the plate fixedly engaged to the ironing board, the first end of the first arm pivotally engaged to the leg assembly at a first pivot joint, the second end of the first arm pivotally engaged to the first end of the second arm at a second pivot joint, the second pivot joint slidingly disposed within the channel, the second end of the second arm pivotally engaged to the bracket.

* * * * *